US008287073B2

(12) United States Patent
Schippers

(10) Patent No.: US 8,287,073 B2
(45) Date of Patent: Oct. 16, 2012

(54) METHOD FOR DETECTING AN OPERATING STATE OF A FLUID CHAMBER OF AN INKJET PRINT HEAD

(75) Inventor: Ronald H. Schippers, Ae Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/035,552

(22) Filed: Feb. 25, 2011

(65) Prior Publication Data

US 2011/0148967 A1 Jun. 23, 2011

Related U.S. Application Data

(63) Continuation of application No. PCT/EP2009/060689, filed on Aug. 18, 2009.

(30) Foreign Application Priority Data

Aug. 27, 2008 (EP) ..... 08163051

(51) Int. Cl.
*B41J 29/38* (2006.01)

(52) U.S. Cl. ..... 347/14; 347/10; 347/11

(58) Field of Classification Search ..... 347/14, 347/10, 11
See application file for complete search history.

(56) References Cited

U.S. PATENT DOCUMENTS

| | | | | |
|---|---|---|---|---|
| 2005/0116977 | A1 | 6/2005 | Shinkawa et al. | |
| 2005/0219286 | A1 * | 10/2005 | Nagashima | 347/9 |
| 2006/0038858 | A1 * | 2/2006 | Ishizaki | 347/68 |
| 2006/0279602 | A1 * | 12/2006 | Dijksman et al. | 347/20 |
| 2008/0136859 | A1 | 6/2008 | Kim et al. | |

FOREIGN PATENT DOCUMENTS

WO 2004/096551 A1 11/2004

* cited by examiner

*Primary Examiner* — Laura Martin
(74) *Attorney, Agent, or Firm* — Birch, Stewart, Kolasch & Birch, LLP

(57) ABSTRACT

In a method for detecting an operating state of at least one fluid chamber of an inkjet print head, after having generated a pressure wave in the fluid chamber, a resulting pressure wave in the fluid chamber is detected. A detection signal corresponding to the detected pressure wave is then generated and a state indicator is determined from the detection signal using a wavelet window, the state indicator being suitable for deriving an operating state of the fluid chamber. This method enables reliable state detection. In an embodiment, it is enabled to perform the state detection between subsequent droplet ejections, thereby obtaining a highly reliable inkjet process.

17 Claims, 3 Drawing Sheets

METHOD FOR DETECTING AN OPERATING STATE OF A FLUID CHAMBER OF AN INKJET PRINT HEAD

CROSS-REFERENCE TO RELATED APPLICATIONS

This application is a Continuation of International Application No. PCT/EP2009/060689, filed on Aug. 18, 2009, and for which priority is claimed under 35 U.S.C. §120, and claims priority under 35 U.S.C. § 119(a) to Application No. 08163051.9, filed in Europe on Aug. 27, 2008. The entirety of each of the above-identified applications is expressly incorporated herein by reference.

BACKGROUND OF THE INVENTION

1. Field of the Invention

The present invention relates to a method for detecting an operating state of a fluid chamber of an inkjet print head, wherein a generated pressure wave is detected and analyzed.

2. Background of the Invention

In a known inkjet printing apparatus having an inkjet print head, the inkjet print head comprises an inkjet fluid chamber. In the fluid chamber, an inkjet fluid is held. The fluid chamber comprises at least one opening, commonly referred to as a nozzle or orifice, through which a droplet of the fluid may be ejected. Ejection may be induced by one of a number of known techniques. For example, local heating of the inkjet fluid may be used to generate a gas bubble due to which a pressure is induced in the fluid chamber resulting in a droplet of fluid being ejected through the nozzle. In another known print head, an electromechanical transducer such as a piëzo-element is used to generate a pressure change in the fluid chamber for ejecting the droplet of fluid.

For print quality, the ejection of an inkjet fluid droplet may be critical. In particular, a droplet may be ejected under an incorrect angle and/or at an incorrect speed or may not be ejected at all due to dirt, air or any other disturbance in the fluid chamber. Further, if the inkjet printing apparatus is used for certain applications, incorrect ejection may lead to an unusable result. Therefore, it is advantageous to determine whether a fluid chamber is in a good operating state and, if it is determined that a fluid chamber is not in a good operating state, using another fluid chamber to eject a droplet at the intended position, for example.

In order to determine whether a fluid chamber is in a suitable operating state, i.e. whether there are no obstructions or disturbances in the fluid chamber, detection of the acoustics of the fluid chamber may be employed. Any chamber has a predetermined acoustic behavior. If a pressure wave, such as an acoustic wave, is introduced in the fluid chamber, the pressure wave will reflect and damp in the fluid chamber over time. Detecting the response to the generated pressure wave allows the presence of objects to be examined, such as dirt or air bubbles or the like, in the fluid chamber. Such a method and a corresponding device are known from the background art.

In the background art, the detected, resulting pressure wave is compared with a reference pressure wave, obtained from an undisturbed fluid chamber. If in the comparison, significant differences are determined, the fluid chamber may be considered to be disturbed and therefore the fluid chamber may be considered to be in an inoperative state. However, such a determination method is sensitive to noise and other measurement imperfections. Further, a quick comparison leads to incorrect determinations, i.e. incorrectly determining that a fluid chamber is in an inoperative state or incorrectly determining that a fluid chamber is in an operative state. A number of incorrect determinations may be decreased by suitable signal processing, which inevitably leads to a relatively long processing time. However, it is desirable to determine the operating state prior to a subsequent use of the same fluid chamber.

SUMMARY OF THE INVENTION

It is an object of the present invention to provide a method for reliably determining an operating state of a fluid chamber.

The above object is achieved in a method for detecting an operating state of at least one fluid chamber of an inkjet print head, the fluid chamber being configured to hold an inkjet fluid and the inkjet print head being configured to eject a droplet of inkjet fluid from the fluid chamber, the method comprising the steps of: (a) generating a pressure wave in the fluid chamber; (b) detecting the pressure wave; (c) generating a detection signal corresponding to the detected pressure wave; and (d) determining a state indicator from the detection signal using a wavelet window, the state indicator being suitable for deriving an operating state of the fluid chamber.

In a further aspect of the present invention, the present invention provides a printing apparatus for ejecting a droplet of an inkjet fluid, the printing apparatus comprising: (a) at least one fluid chamber, the fluid chamber being configured for holding an inkjet fluid and for ejecting a droplet of the inkjet fluid; (b) a pressure generator operatively coupled to the fluid chamber, the pressure generator being configured to generate a pressure wave in the fluid chamber; (c) a detector operatively coupled to the fluid chamber, the detector being configured to detect the pressure wave in the fluid chamber and generate a corresponding detection signal; and (d) a determining device operatively coupled to the detector, the determining device being configured to receive the detection signal and determine a state indicator based on the received detection signal using a wavelet window.

In the method according to the present invention, a pressure wave is generated in the fluid chamber. The pressure wave may be a pressure wave for ejecting a droplet or the pressure wave may be a pressure wave configured for operating state detection, i.e. not intended for ejecting a droplet. Further, the inkjet print head may be configured to eject inkjet fluid droplets by generating such a pressure wave, but the inkjet print head may as well be configured to eject a droplet by any other technique and may be configured to only generate such a pressure wave for operating state detection.

The pressure wave may be generated by any suitable means. Such means include an electromechanical transducer such as a piëzo-actuator. Other suitable means are known to one having ordinary skill in the art. For example, gas bubble generation by heating may be employed. It is noted that it is preferred that the shape of the pressure wave is substantially the same each time the pressure wave is generated, which enables the comparison of the resulting pressure wave with a reference pressure wave.

Then, the resulting pressure wave is detected. The detection may be performed by any suitable means. For example, an electromechanical transducer may be used. Moreover, if an electromechanical transducer is used for pressure generation, the same electromechanical transducer may be used for detection, as is known from the background art.

Based on the detected pressure wave, a detection signal corresponding to the detected pressure wave is generated. Usually, the detector outputs an electrical signal corresponding to the detected pressure wave.

From the detection signal, a state indicator is determined. Thereto, a wavelet window is used. The wavelet window may be used to determine a wavelet transform of the detection signal, thereby obtaining a wavelet transformed detection signal. In an embodiment, a reference signal may be employed. Such a reference signal may be a wavelet transformed pressure wave of a fluid chamber in an operative state. Then, the wavelet transformed detection signal may be compared with the reference signal. However, as is described in detail below, in an embodiment, no complete wavelet transform of any signal is performed, although such an embodiment is based on wavelet theory.

In an embodiment, the wavelet window comprises a sine-wave. Using a sine-wave allows detection of a substantially single-frequency content in the detection signal. In particular such a frequency is substantially equal to a resonance frequency of the fluid chamber. In response to a generated pressure wave, most frequencies in the pressure wave are relatively quickly damped except for any frequencies resonating in the fluid chamber. Consequently, the resonance frequencies are not damped by the structure, but are only damped by the fluid dynamics. Hence, after a short period of time, the resonance frequencies of the fluid chamber remain, while other frequencies are cancelled. As any objects and/or disturbances in the fluid chamber change the resonance frequencies of the fluid chamber, detection of the resonance frequencies (frequency, amplitude, phase) provides information about the contents of the fluid chamber. Selecting the wavelet window to have a signal content corresponding to a (main) resonance frequency of the fluid chamber allows verification of whether the fluid chamber reacts as a fluid chamber in an operative state, or not.

In order to remove any resulting influence of an offset of the detection signal, it may be preferred to use a wavelet window containing an integer number of full periods of the sine-wave used. If the wavelet window contains an integer number of full periods of a sine wave the resulting coefficient will be (substantially) equal to zero and will thus not contribute to the result, as desired.

Likewise, if an additional, disturbing signal is contained in the detection signal, it may be preferred to use a wavelet window comprising a sine wave, wherein the period of the sine wave is selected to be an integer multiple of the period of the disturbing signal. For example, if the disturbing signal has a frequency of about 250 kHz (corresponding to a period of 4 microseconds), it may be desirable to use a sine wave having a frequency of about 50 kHz (corresponding to a period of 20 microseconds), because the signal content of the disturbing signal will not (significantly) contribute to the result of the determination.

In an embodiment, the wavelet window is provided, e.g. selected or generated, using a set of predetermined detection signals. Such a set of predetermined detection signals comprises at least one detection signal originating from an operative fluid chamber and at least one detection signal originating from a non-operative fluid chamber. Based on such a set of predetermined detection signals, a wavelet window may be determined, which wavelet window distinguishes the signal from the operative fluid chamber and the signal originating from the non-operative fluid chambers well. Thus, any incorrect determinations may be prevented, or at least a number of incorrect determinations may be kept low. For example, a number of potentially suitable wavelet windows may be used and the wavelet window providing a largest difference in the resulting values may be selected as the wavelet window to be used. However, a person skilled in mathematics readily understands that a number of mathematical methods are available for generating, e.g. calculating, a best distinguishing wavelet window.

In a particular embodiment of the above described embodiment, at least one of the predetermined detection signals comprised in the set of predetermined detection signals is an averaged signal. For example, the signal originating from an operative fluid chamber may be averaged from a number of signals originating from one or more operative fluid chambers. Detection signals originating from a non-operative fluid chamber may be averaged by averaging signals originating from one or more non-operative fluid chambers having a same cause for their non-operative state. Thus, an (unknown) deviation in one of the detection signals is averaged and the influence of the deviation on the wavelet window is decreased.

In order to further simplify the fluid chamber state determination, only a part of the detection signal may be used in the determination. In particular, certain parts of the detection signal may be unsuitable to be used in the determination. For example, a first part of the detection signal may be primarily resulting from electrical influences due to into circuit switching of a detection circuit, or the like. Likewise, with time, a signal-to-noise ratio (SNR) of the detection signal may become such that no reliable determination is possible anymore. Hence, a part that has a suitable SNR and which mainly represents a resonance signal resulting from the generated pressure wave may be selected for the determination, allowing omission of any signal processing for removing noise, and the like. Further, by suitable selection of the detection signal part in relation to the wavelet window, in particular in relation to the phase of the wavelet window, and by selecting the part of the detection signal to have a length corresponding to a length of the wavelet window, only a single vector multiplication is required to obtain a scalar value.

Since the scalar value will change if one or more of the amplitude of the detection signal, the phase of the detection signal and/or the frequency of the detection signal changes, the scalar value may be compared to a reference scalar value that is similarly obtained for an operative fluid chamber in order to determine whether the fluid chamber is in an operative state, or not. In particular, by dividing the scalar value of the detection signal and the reference scalar value relating to an operative fluid chamber, the fluid chamber may be considered to be in an operative state, if the result of the division is substantially equal to 1. For example, a threshold value may be empirically (pre)determined such that it may be easily determined whether the fluid chamber is in an operative state, or not.

It is noted that the above-described embodiment only uses a vector multiplication of the wavelet window and (a part of) the detection signal. Such a vector multiplication may be performed already when the detection signal is being sampled, as is explained in detail below. As a result, the multiplication and determination of the state of the fluid chamber resulting therefrom is virtually ready as soon as the last detection signal sample is received by the determination device. Thus, the method according to the present invention enables the determination of an operating state of a fluid chamber reliably prior to ejecting a subsequent droplet. If the determination indicates that the fluid chamber is not in an operative state, the subsequent ejection may be cancelled and, for example, the droplet may be ejected by another fluid chamber.

It is noted that an embodiment of the method according to the present invention may be supplemented by additional method steps. For example, in the above-described embodiment of the method, it is merely determined whether a fluid chamber is in an operative state, or not. If it is determined that a fluid chamber is not in an operative state, it remains unclear why the fluid chamber is in such a state. Moreover, since the cause remains unclear, it remains unclear if and how the fluid chamber may become operative again. Therefore, further method steps may be used for determining a cause for the inoperative state and possibly determining and performing an action for removing the cause. For example, upon detection of an inoperative fluid chamber, the fluid chamber may be further examined by a detailed analysis, e.g. by using a full wavelet transform, a Fourier transform or time domain analysis, and depending on the result of such further examination, performing corrective action. While the inoperative fluid chamber is under examination, the printing apparatus may address other fluid chambers to eject droplets, thereby functionally replacing the inoperative fluid chamber.

As above described, a full analysis or examination may be performed to determine a cause of the inoperative state. Such full examination may include comparison with typical detection signals for one or more different causes. Each cause has such a typical detection signal. The significant features may be best detected in the time-domain detection signal or in a transformed detection signal, such as a Fourier transformed detection signal or a wavelet transformed signal. A person skilled in the art readily understands how such a comparison may be performed and therefore a detailed description of such a comparison is omitted here.

In an embodiment, a full examination is not only performed for an inoperative fluid chamber, but is performed for each fluid chamber, for example while the fluid chambers are being used during a printing operation. For example, while a first result may indicate that the fluid chamber is in an operative state and may be used for ejecting droplets, a full analysis or examination may reveal that the fluid chamber may become inoperative in the near future, because a probable cause for an inoperative state is developing. As a detailed example, a small air bubble in a fluid chamber may not significantly influence the operation of the fluid chamber, but a large air bubble may put a fluid chamber in an inoperative state. As soon as a small air bubble is detected, it may be preferred to perform corrective action to prevent that the air bubble grows into a large air bubble. Using a full analysis, while the fluid chamber is actually being used for printing after having determined that the fluid chamber is in an operative state, it may be determined that a small air bubble is present in the fluid chamber. Then, the fluid chamber may be excluded from printing and being functionally replaced by another fluid chamber, while a suitable corrective action is being performed on the fluid chamber in order to remove the small air bubble.

As above noted, the amplitude of the detection signal influences the result of the determination. The amplitude depends inter alia on the viscosity of the ink and hence on the temperature of the ink. If the temperature of the ink is accurately controlled, a single wavelet and reference signal are sufficient to obtain reliable results. If the temperature is not accurately controlled, a temperature sensor may be applied and, based on a detected temperature, the wavelet and the reference signal may be adapted. For example, a number of wavelets and reference signals may be predetermined as a function of the temperature. Then, based on the detected temperature, corresponding ones of the predetermined number of wavelets and predetermined number of reference signals may be selected for determining the state of the fluid chamber.

Moreover, since the viscosity is the important property of the ink, the viscosity may be determined and the wavelet and/or the reference signal may be adapted to the detected viscosity. Such an embodiment enables use of different kinds of ink without disturbing the detection of the state of the fluid chamber.

In another embodiment, the above consideration may as well be employed to control the temperature of the ink. Considering that disturbances in a fluid chamber are exceptional, it may be presumed that a majority of a relatively large number of fluid chambers—e.g. comprised in one print head—is in an operative state. Hence, using a wavelet window and a reference signal, each having been predetermined at a desired operating temperature, a mode (also known as the modal score) of all state indicators of the number of fluid chambers may be considered to represent the state indicator of an operative fluid chamber. It is noted that also other mathematical operations such as a mean or a median may be employed. If this state indicator significantly deviates from a predetermined state indicator corresponding to an operative fluid chamber containing ink at the desired temperature, it may be determined that the ink is not at the desired temperature and the temperature may be adapted in response to the detected state indicators.

In an embodiment, no predetermined reference signal or scalar corresponding to an operative fluid chamber is used. As above described, presuming that a majority of the examined and analyzed fluid chambers is in an operative state, such a reference signal or scalar is derivable from the detection results of a plurality of fluid chambers as above described. So, in this embodiment, instead of (or in addition to) controlling the temperature of the ink based on a mode (or mean or median or the like) of the detection results, a reference value may be determined and employed in determining which fluid chambers are not in an operative state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
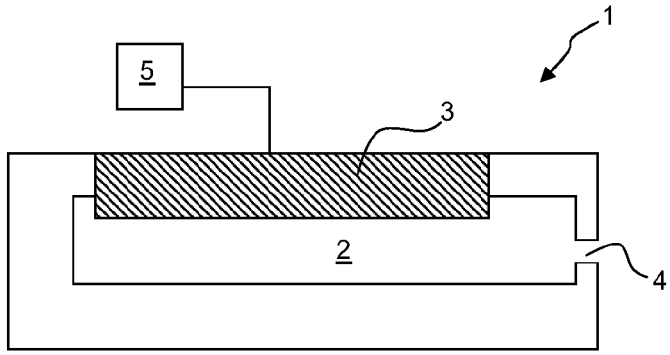
FIG. 1 is a schematic view of an inkjet print head.

The present invention will now be described with reference to the accompanying drawings, wherein the same reference numerals have been used to identify the same or similar elements throughout the several views.

FIG. 1 shows an inkjet print head 1 comprising a fluid chamber 2, an actuator 3 and a nozzle or orifice 4. Such a print head 1 is well known in the art. The print head 1 is operatively coupled to a control unit 5.

In operation, the fluid chamber 2 is filled with a fluid such as ink. The fluid may be provided and replenished through a channel (not shown) which couples an ink reservoir (not shown) to the fluid chamber 2.

The actuator 3 is illustrated as an electromechanical transducer such as a piëzo-electric element. Upon receipt of a drive signal, the piëzo element 3 deforms and, as a result, a pressure wave is generated in the fluid in the fluid chamber 2. Further, after having generated the pressure wave, the piëzo element 3 is employed as a sensor. The pressure wave in the fluid chamber 2 attenuates over time, depending on the characteristics of the fluid and characteristics of the fluid chamber 2. During this attenuation period, the pressure wave deforms the piëzo element and, as a result, the piëzo element generates an electrical signal that is received by the control unit 5. From the electrical signal, the pressure wave present in the fluid chamber 2 may be determined over time.

It is noted that other kinds of pressure wave generating actuators are known in the art, which may be used in the present invention. For example, a heater may be used as an actuator. By heating, a gas bubble is formed in the fluid chamber 2 by vaporization of a part of the fluid. As the gas uses more space than the corresponding amount of fluid, the pressure in the fluid chamber 2 increases. Also, other kinds of actuation may be employed. In any case, in order to be able to perform the method according to the present invention, the pressure in the fluid chamber 2 needs to be determined over time. If the actuator 3 is not suitable to be employed as a pressure sensor, another pressure sensing element should be provided, for example a dedicated separate pressure sensor.

In order to expel a droplet of fluid through the nozzle 4, a suitable drive signal is generated by the control unit 5 and provided to the actuator 3. The actuator 3 generates the pressure wave in the fluid chamber 2, as above explained. Due to the increased pressure in the fluid chamber 2 an amount of fluid is forced through the nozzle 4 and, as a result, expelled as a droplet.

In order to determine a state of the fluid chamber 2, after actuation, the actuator 3 may provide a detection signal to the control unit 5. The control unit 5 may analyze and examine the detection signal. As above mentioned, the generated pressure wave remains for a period of time in the fluid chamber 2. In that period of time, the pressure wave attenuates. However, certain contributions in the pressure wave attenuate more quickly than others. In particular, a pressure wave at a resonance frequency of the pressure chamber 2 will only attenuate due to the fluid characteristics and will therefore remain longer than contributions having a non-resonant frequency.

If an air bubble or dirt is present in the fluid chamber 2, the resonance frequency or resonance frequencies of the fluid chamber 2 are altered. Consequently, the pressure wave in the fluid chamber 2 after actuation will attenuate differently compared to a clean and operative fluid chamber 2. Thus, by suitable analysis and examination of the detection signal, the state of the fluid chamber 2 may be derived. This is known from the background art. However, in the background art, the examination is performed on the detection signal by comparing the detection signal with a reference detection signal. This requires a full detection signal, which requires awaiting the completion of the sensing. Further, such a comparison takes a relatively long time and the results may not be sufficiently reliable.

In order to increase the reliability of the examination, in accordance with the present invention, the examination is preceded by a suitable analysis based on wavelet theory. Using an analysis based on a wavelet transformation, more relevant information is retrieved from the detection signal. The wavelet transformation provides information on separate signal contributions, wherein the signal contributions are split based on characteristics of a predetermined wavelet window. For example, the wavelet window may be selected to provide information on a signal contribution having a certain frequency. Further, by application of the wavelet window on parts of the detection signal, the results of the wavelet transformation also provides information on a moment in time in which the signal contribution is present in the detection signal. The latter is an important difference with a Fourier transformation, which assumes a same signal contribution (contributions split based on frequency) throughout the length of time, whereas the signal contributions may change over time, as in the present detection signals.

While a full wavelet transformation and subsequent examination may take a relatively long period, the inventors of the present invention have acknowledged that the method may be simplified, thereby possibly reducing the amount of information obtained, but significantly speeding the analysis and examination such that the analysis and the examination of each fluid chamber 2 may be performed between two subsequent actuations. This enables cancellation of the subsequent actuation, if it is determined that the fluid chamber 2 is not in an operative state, and to replace the droplet to be expelled by said fluid chamber 2 by a droplet expelled by another, operative fluid chamber 2. Hereinafter, the simplified method is described in further detail, while illustrating and describing how to use a full wavelet transformation and the possibilities such full wavelet transformation may provide.

Figure 2A:
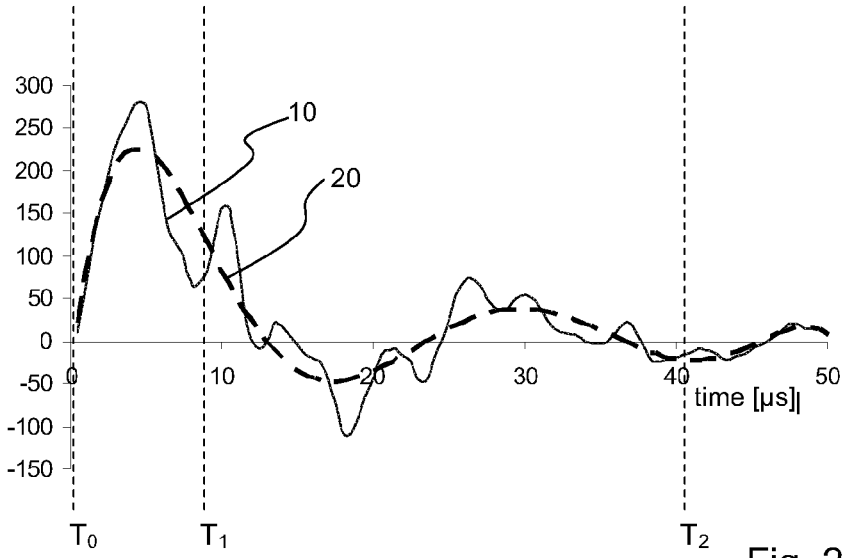
FIGS. 2A-2C illustrate a detection signal obtained from a well-functioning inkjet print head according to FIG. 1.
Figure 2B:
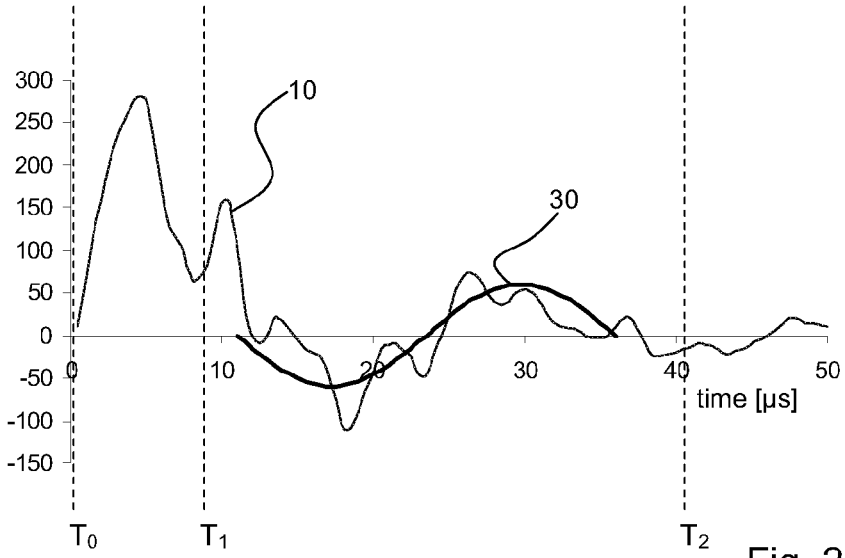
Figure 2C:
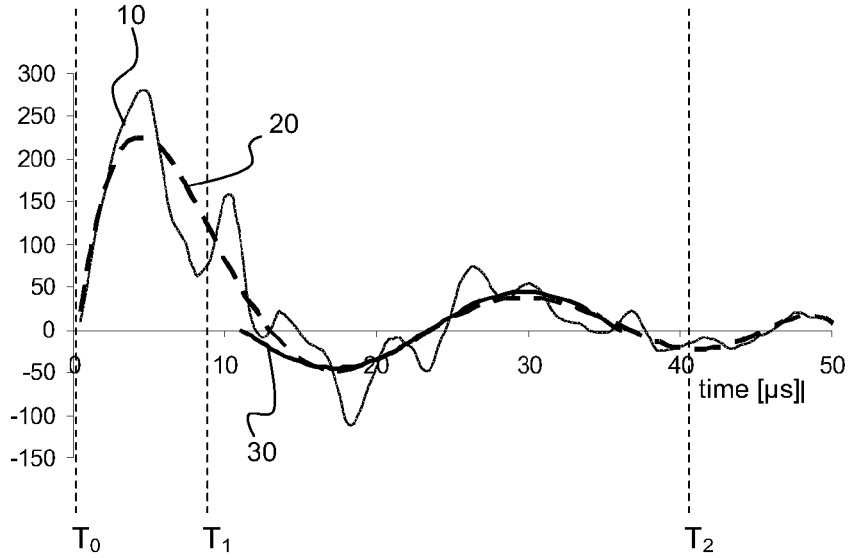

FIGS. 2A-2C each show a diagram comprising an actual detection curve 10 of an operative, not disturbed fluid chamber. The detection curve 10 is obtained experimentally and starts shortly after actuation of the actuator and is detected for about 50 Further, a trend line curve 20 is shown in FIGS. 2A and 2C. The trend line curve 20 is only shown for illustrative purposes and is generated by calculating a sixth order polynomial function based on the detection signal underlying the detection curve 10. In FIGS. 2B and 2C a single-period sine-wave curve 30 is shown.

Now, referring to FIG. 2A, the detection curve 10 starts to increase rapidly from the start of the detection and after about 6 μs, the detection curve 10 rapidly falls. This first part of the detection curve 10 extending from T0 to T1 is most probably a result from the detection circuitry responding to switching on directly after actuation. The detection signal in the time period T0-T1 is in any case most probably not representative for the actual pressure wave in the fluid chamber. Therefore, this first period of time T0-T1 may be omitted in further analysis and examination, although this is not essential in the method according to the present invention.

After T1, the detection curve 10 appears to contain a significant low-frequency contribution and a significant high-frequency contribution. The low contribution is best seen in the trend line curve 20. The high frequency contribution is best seen from a difference between the detection curve 10 and the trend line 20.

After T2, the actual detection signal may become very weak and noise may get a significant influence. As any analysis and examination is preferably not significantly influenced by noise, it may be preferred to omit the signal part after time T2, although this is not essential in performing the method according to the present invention.

Considering that the detected pressure wave has most probably contributions having frequencies corresponding to resonance frequencies of the fluid chamber, a sine-wave curve 30 having a frequency corresponding to an important resonance frequency of the fluid chamber, that is the resonance frequency corresponding to the dimension of the fluid chamber extending in the direction of droplet ejection, which is in the illustrated example about 40 kHz, is shown in FIG. 2B superposed on the detection curve 10. As shown in FIG. 2C, the sine-wave curve 30 substantially coincides with the mathematically determined trend line curve 20. Hence, it may be concluded that the low-frequency contribution in the detection curve 10 corresponds to the resonance frequency of the fluid chamber.

As the low-frequency contribution provides sufficient information about any disturbances or obstructions in the fluid chamber, the hereinafter described embodiment of the method according to the present invention focuses on this low-frequency contribution. In this embodiment, which is described in further detail below, not a full wavelet transformation is performed. Instead, the sine wave having a frequency corresponding to the low-frequency contribution, in this case 40 kHz, is selected as a wavelet window and it is applied to the signal part with which it should coincide, that is the signal part between about 11 μs and 36 μs. Vector multiplication of the said signal part and the selected wavelet window provides the wavelet coefficient corresponding to that wavelet window and the signal part. If such a wavelet coefficient corresponds to the same wavelet coefficient derived from a reference signal associated with an operative fluid chamber, it may be considered that the fluid chamber is in an operative state.

In the above described practical embodiment, the analysis and the examination, including the determination of the state of the fluid chamber, may be performed even before a subsequent actuation. This may be derived as follows. The detection signal is being sampled over time, thereby obtaining a discrete number of detection samples. For applying the present invention, the continuous wavelet transform is used as a start:

$$T(a, b) = C(a)\int_{-\infty}^{\infty} f(t)\psi\left(\frac{t-b}{a}\right)dt$$

in which T(a,b) represents the wavelet coefficient in which a is the scale (frequency) parameter and b is the location or shift parameter, C(a) is a factor depending on parameter a (not relevant to the present discussion), f(t) is the function to be transformed, in the present case the detection signal, ψ represents the wavelet window and t represents time.

Taking a sine wave of a single period T as the wavelet window, ψ is zero outside the wavelet window, so the integral may be limited to the time period [−½T, ½T]. Taking only a sine wave of a predetermined frequency (e.g. 40 kHz), the scale parameter becomes a single value A and the factor C(a) becomes a constant Ca. Further, taking only a single position relative to the detection signal into account, the location parameter becomes a single value B. Thus, the wavelet transformation becomes:

$$T(A, B) = C_a\int_{-\frac{1}{2}T}^{\frac{1}{2}T} f(t)\psi\left(\frac{t-B}{A}\right)dt$$

In a practical embodiment, the detection signal is digitized by sampling. Therefore, the above equation is rewritten in discrete form and Ca is omitted as this is a constant:

$$T'(A, B) = \sum_{n=0}^{N} f(n)\psi(n)$$

Thus, a simple vector multiplication is obtained. Moreover, while the detection signal is being received and sampled, the vector multiplication may be started as soon as the first required sample f(0) has been received. Then, with each subsequent sample, the multiplication can directly be performed such that as soon as the last required sample f(N) is received only one multiplication and only one addition has to be performed in order to obtain T'(A,B).

T'(A,B) may be used as a state indicator. The state indicator may be compared to the state indicator of an operative fluid chamber in order to determine whether a fluid chamber is in an operative state, or not.

In another embodiment, T'(A,B) of the fluid chamber being examined and T'(A,B) of an operative chamber are divided, thereby obtaining a state indicator which is substantially equal to one, if the examined fluid chamber is in an operative state. In particular, a threshold may be predetermined for determining whether a fluid chamber can be used, or not. For example, in an embodiment, if the state indicator has a value in the range [0.75, 1.25], it may be determined that the fluid chamber is in a suitable state for operation.

It is noted that the above-described simplified method may be embodied by a single, simple processor unit, which may even be integrated on a print head, while background art methods require such hardware that processing was required to be performed in a processing unit arranged separate from the print head. This may result, for example, in a simplified interface between the print head and a control unit. While in the background art, the full detection signal is needed to be transferred to the processing unit (e.g. incorporated in the control unit), in the present method, the processing may be performed on the print head and it may be sufficient to transfer information about which nozzles are in a non-operative state. Transfer of such information requires far less data transfer and hence a simplified interface may be provided, while maintaining full functionality.

Figure 3A:
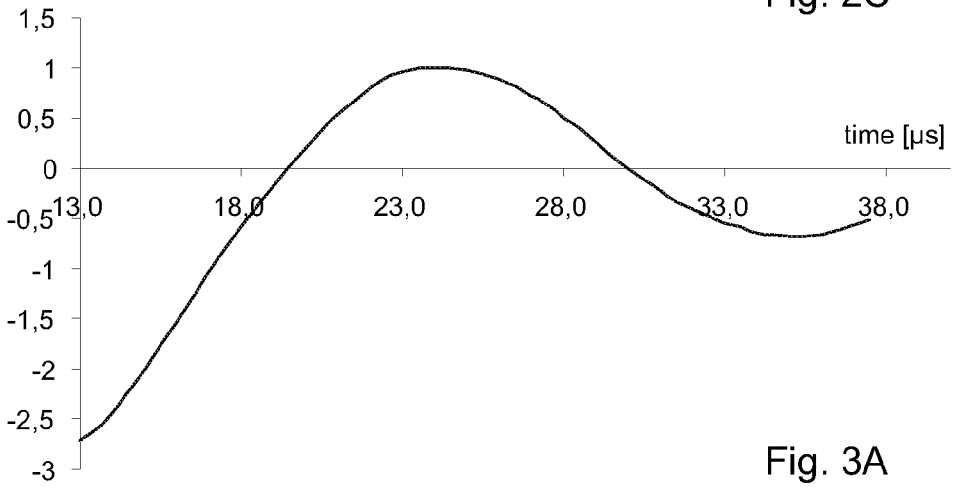
FIGS. 3A-3C illustrate the operation of an embodiment of a method according to the present invention based on the detection signal shown in FIGS. 2A-2C.
Figure 3B:
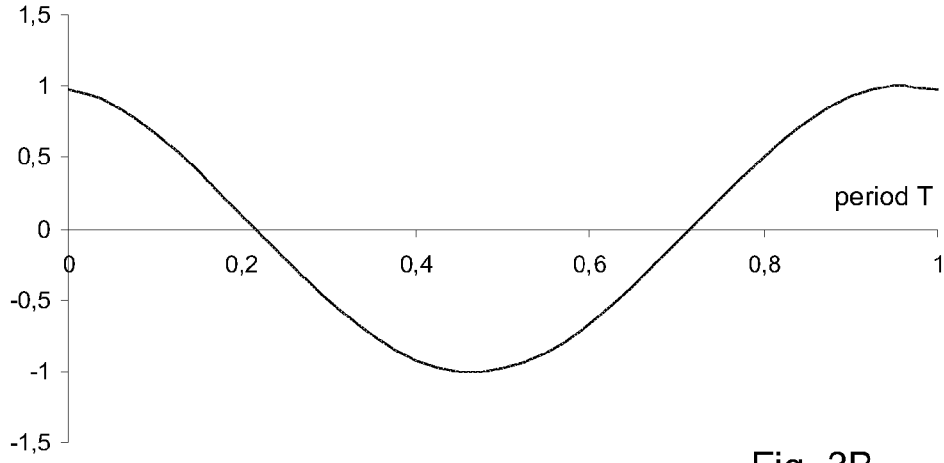
Figure 3C:
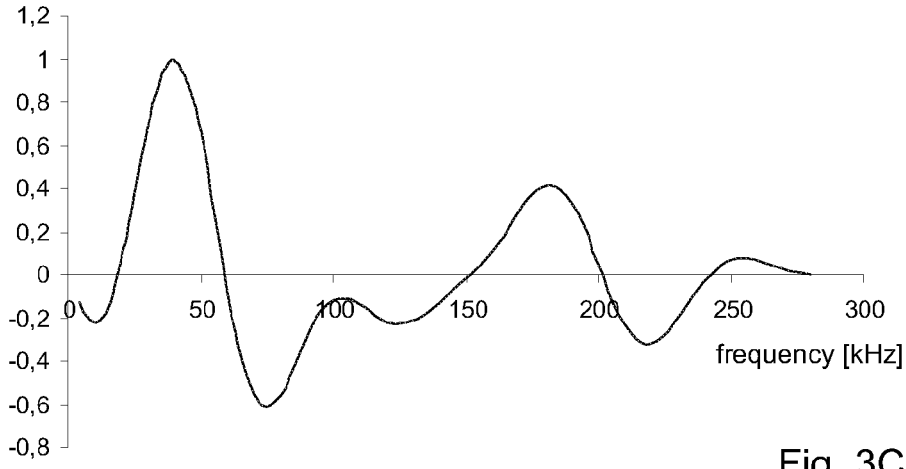

FIGS. 3A-3C illustrate how the above-described wavelet coefficient is influenced by relative changes between the wavelet window and the detection signal. It is noted that the illustrated curves and graphs do not correspond to a full wavelet transform exactly following wavelet transform theory. Each graph is based on vector multiplication of a wavelet window and a part of the detection signal. In terms of the above derivation of the vector multiplication, the graphs as shown in FIGS. 3A-3C are derived by varying the values of A and B and not by actual wavelet transformation.

Referring to FIG. 3A, the horizontal axis represents a position of a center of the wavelet window, i.e. the center zero crossing of the sine wave, relative to the detection signal. At the left hand side of the diagram, at x-axis position 13,0, the wavelet window center is positioned at 13,0 μs (see, e.g. FIG. 2A), which corresponds to saying that the wavelet window curve 30 is positioned at the start of the detection curve 10. For example, in FIGS. 2B and 2C, the center of the sine-wave wavelet window 30 is positioned at about 24 μs, which corresponds to a maximum of the curve in FIG. 3A having a value of about 1.

The vertical axis of the diagram in FIG. 3A indicates a normalized value of the above-described vector multiplication of the sine-wave wavelet window and the corresponding respective signal parts, i.e. a normalized wavelet coefficient. As above indicated, the wavelet coefficient is at a maximum at the position of the sine-wave wavelet window shown in FIGS. 2B and 2C. Shifting the wavelet window along the horizontal axis results in a decrease of the wavelet coefficient. Likewise, if the detection signal would shift in time due to any disturbance, or the like, the wavelet coefficient will decrease, which is easily detectable.

In FIG. 3B, the horizontal axis indicates a phase of the sine-wave of the wavelet window. The wavelet coefficients shown are determined using sine-wave wavelet windows each having a different phase and performing a vector multiplication with each wavelet window at the position relative to the detection signal shown in FIG. 2B. Thus, the position of the sine-wave wavelet window is maintained at the position shown in FIGS. 2B and 2C, but the phase of the sine wave is changed. The units indicated on the horizontal axis correspond to a period of the sine wave. Thus, it is illustrated how the normalized wavelet coefficient changes with changing phase. As seen from FIG. 3B, the normalized wavelet coefficient is at a maximum with a phase shift of about 0,95 of the sine-wave period. With a phase shift of the sine wave of about half a period, the wavelet coefficient is at a minimum. Similarly, if the phase of the detection signal changes, the wavelet coefficient will be at a maximum, if the phases of both signals correspond, and will decrease with an increase of a relative phase shift between the two signals.

FIG. 3C shows the wavelet coefficient as a function of a frequency of the sine-wave wavelet window. The wavelet coefficients shown are determined using sine-wave wavelet windows having different frequencies and performing a vector multiplication at the position relative to the detection signal as shown in FIG. 2B.

As easily seen from FIG. 3C, there is a large signal contribution having a frequency of about 40 kHz, which corresponds to the low-frequency contribution as discussed in relation to FIGS. 2A-2C and which corresponds to the significant resonance frequency of the fluid chamber. As seen in FIG. 3C, if the frequency of the sine wave and the detection signal do not match, the wavelet coefficient is decreased. It is noted that a relatively large signal contribution having a frequency of about 180 kHz appears to be present. Indeed, the frequency of the high-frequency contribution in the detection signal (see above in relation to FIG. 2A) has a frequency of about 180 kHz, so this appears to be correct.

Still referring to FIG. 3C, there is a relatively large contribution at 80 kHz, but the detection signal contribution and the sine-wave of the wavelet window are in opposite phase. The 80 kHz may be a higher order frequency of the 40 kHz resonance. Further, significant signal contributions having frequencies of about 120 kHz and 220 kHz are seen. Further discussion of the origin of such frequencies is not relevant to the present invention and is omitted here. However, it is noted that such other frequencies may show that a certain disturbance is present in the fluid chamber. So, after having determined that a fluid chamber is not in an operative state, a full wavelet transformation may be performed in order to determine what causes the inoperative state.

Figure 4A:
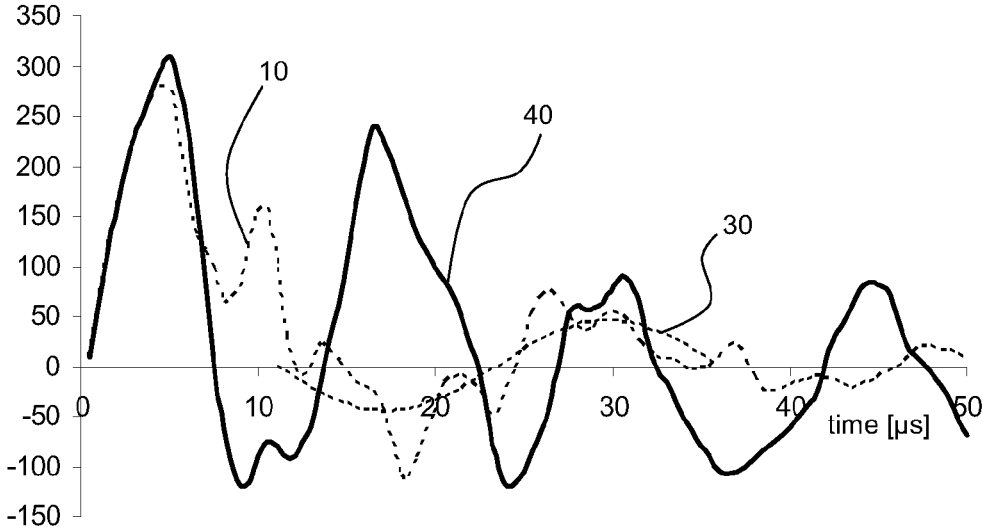
FIG. 4A illustrates a detection signal corresponding to a fluid chamber containing an air bubble.

FIG. 4A illustrates a disturbed detection signal 40 received from a fluid chamber that contains air, e.g. an air bubble, even such that the air in the fluid chamber disturbs an ejection of a droplet of fluid, and hence it is to be determined that the fluid chamber is in a non-operative state. In order to illustrate a difference between the disturbed detection signal 40 and the original detection signal 10 received from an operative fluid chamber, the original detection signal 10 and the sine-wave signal 30 are shown in FIG. 4A using a dashed curve.

As is apparent from FIG. 4A, the disturbed detection signal 40 deviates significantly from the original detection signal 10. Moreover, by comparing the disturbed detection signal 40 and the sine-wave signal 30, it is apparent that the desired resonance frequency of the fluid chamber is not significantly present in the disturbed detection signal 40.

Figure 4B:
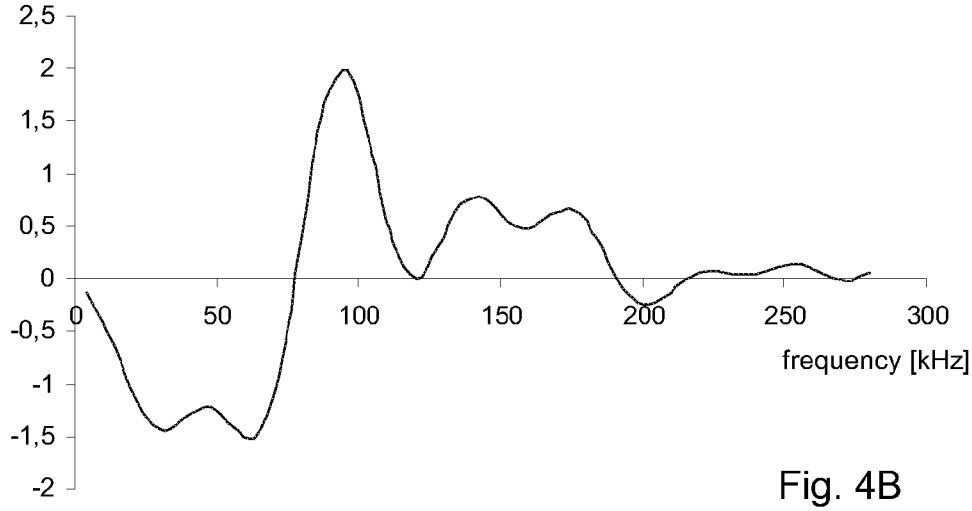
FIG. 4B illustrates the operation of an embodiment of a method according to the present invention based on the detection signal shown in FIG. 4A.

FIG. 4B shows the wavelet coefficients as a function of the frequency of the sine-wave wavelet window (cf. FIG. 3C) of the disturbed detection signal 40. The wavelet coefficients are normalized to the wavelet coefficient at 40 kHz of the original detection signal 10. As is apparent from FIG. 4B, the signal contribution having a frequency of about 40 kHz is significantly changed. The normalized wavelet coefficient has now a value of about −1.3 (instead of about 1, which it would have if the fluid chamber would be in an operative state). Based on this value, it is determined that the fluid chamber is not in an operative state.

Further, still referring to FIG. 4B, the frequency curve of the disturbed detection signal 40 may be used to determine a cause of the non-operative state. For example, it is apparent that a large signal contribution having a frequency of about 80 kHz is present in the disturbed detection signal 40. Such a shift in major frequency content from 40 kHz to 80 kHz may be illustrative for any fluid chamber containing air or dirt. Such considerations are however not part of the present invention and are therefore not further elucidated here.

In the above description and discussion of the present invention, a sine-wave wavelet window is applied. However, although the sine-wave wavelet has proven to be a suitable embodiment for performing the present invention, other wavelets may be used as well. Moreover, other wavelets may prove to provide other and possibly even better results in the sense of certain aspects of the method and corresponding results. For example, it is contemplated that for determining a cause of a non-operative state, a wavelet transformation using another wavelet may be used advantageously. Likewise, it is noted that the resonant signal contribution attenuates in the course of time. So, it may be advantageous to adapt the sine-wave wavelet to include a factor representing the attenuation. Also, other aspects and characteristics may easily be incorporated in the method according to the present invention.

In an embodiment, the actuation prior to detection of the detection signal is an actuation for expelling a droplet of fluid. However, in another embodiment, the actuation is merely an actuation for generating a pressure wave without expelling a droplet of fluid in order to merely examine the state of the fluid chamber.

In the above description of the present invention and a number of embodiments thereof, it has been assumed that a single reference value derived from a detection signal originating from an operative fluid chamber is constant over time and is the same for each fluid chamber. However, in practice, the acoustics of the fluid chambers may (slightly) change over time, for example due to deposits of ink compounds and/or pollution, and the acoustics of different fluid chambers may slightly vary. Therefore, in an embodiment, a dedicated reference value is determined for each fluid chamber and/or the reference value is updated at certain intervals in time. In more particular embodiments, the reference value and/or a reference signal may be derived from an averaged detection signal. Such an averaged detection signal may be an average from detection signals of all fluid chambers or from pre-selected fluid chambers. For example, only the detection signals that are substantially equal are used for averaging as it may be assumed that those signals represent an operative fluid chamber. Thus, an averaged detection signal as a reference signal is not disturbed by detection signals originating from non-operative fluid chambers. A person skilled in the art readily recognizes that also other, alike methods are conceivable. Further, it is noted that such method is not only applicable to the present invention, but may as well be employed in background art and/or similar methods in which a reference signal, parameter or value is employed.

In yet another embodiment, the state of a nozzle is not determined on an absolute basis, but relative to its replacement nozzle. In such an embodiment, an ink drop to be provided on a predetermined position on a recording medium may be ejected by two or more nozzles (and their associated fluid chambers). Using the method according to the present invention, each fluid chamber obtains a value indicating its operative state. In this embodiment, the values associated with all nozzles that may address the predetermined position on the recording medium are compared. The nozzle having the best value will be used for actually ejecting the drop to be positioned on said position.

In an embodiment, the detection signal may be preprocessed before the wavelet window is operated on the detection signal. For example, an electrical charge residue may be present in a piezo-actuator after actuation. Such charge residue may flow from the actuator, while also the residual pressure wave results in the desired detection signal. By suitable preprocessing any signal contribution due to such relaxation of the piezo-actuator may be filtered from the detected signal using common (mathematical) methods. Also other signal contributions that are known to be present in the detection signal could be likewise removed prior to wavelet processing. Further, depending on a cause of the undesired signal contribution, preprocessing other than filtering may be suitable for obtaining a clean detection signal that is substantially free from signal contributions other than residual pressure wave contribution. It is noted that such preprocessing is not limited in use to the present invention, but may as well be used in any other method for detecting an operating state of a fluid chamber.

In an embodiment, not all fluid chambers of a print head may be analyzed separately. In order to reduce required processing power, a summed detection signal may be calculated by adding a number of detection signals originating from a respective number of fluid chambers. Then, the summed detection signal is analyzed and, if it is determined that the summed detection signal corresponds to a signal originating from an operative fluid chamber, it is determined that all of the number of fluid chambers are in an operative state. If the summed detection signal does not correspond to an operative fluid chamber, the number of detection signals are divided over multiple, e.g. two, subsets and a summed detection signal is generated for each of the subsets. Then, for each subset, it is determined whether all the fluid chambers associated with the subset are in an operative state. Of course, at least one of the subsets then comprises a detection signal corresponding to a non-operative fluid chamber. So, these method steps are repeated for each subset in which a non-operative fluid chamber detection signal is comprised, until the detection signal of at least the non-operative fluid chamber is identified and analyzed separately, while many detection signals originating from operative fluid chambers may not have been analyzed separately. In a preferred embodiment the detection signals of the number of detection signals are added prior to analogue-to-digital (A/D) conversion, reducing the processing power for the A/D-conversion. However, in order to control (maintain) the accuracy of the A/D conversion, a programmable gain amplifier (PGA) may be employed such that the analogue signal supplied to the A/D converter has such an amplitude that the accuracy is not decreased. The gain of the PGA may be set based on the number of detection signal summed (i.e. comprised in the summed detection signal). As for the above described embodiment, it is noted that use of such an analysis scheme is not limited in use to the present invention, but may as well be used in any other method for detecting an operating state of a number of fluid chambers.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims and/or embodiments may be applied in combination and any combination of such claims and/or embodiments are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for detecting an operating state of at least one fluid chamber of an inkjet print head, the fluid chamber being configured to hold an inkjet fluid and the inkjet print head being configured to eject a droplet of inkjet fluid from the fluid chamber, the method comprising the steps of:

(a) generating a pressure wave in the fluid chamber;

(b) detecting the pressure wave;

(c) generating a detection signal corresponding to the detected pressure wave; and (d) determining a wavelet window suitable for use in a wavelet transformation in accordance with wavelet theory and determining a state indicator from the detection signal using the wavelet window in accordance with wavelet theory, the state indicator being suitable for deriving an operating state of the fluid chamber.

2. The method according to claim 1, wherein the wavelet window comprises a sine-wave.

3. The method according to claim 1, wherein the wavelet window is formed by one or more full periods of a sine-wave.

4. The method according to claim 2, wherein a frequency of the sine wave corresponds to a resonance frequency of the fluid chamber.

5. The method according to claim 2, wherein the detection signal comprises a disturbance signal having a substantially predetermined frequency and wherein the sine wave is selected such that a frequency of the disturbance signal is a higher-order harmonic of the sine wave.

6. The method according to claim 1, wherein the step (d) further comprises:

(d1) selecting a part of the detection signal; and (d2) determining the state indicator based on the selected part of the detection signal.

7. The method according to claim 1, wherein the step (d) further comprises:

(d3) multiplying the detection signal with the wavelet window;

(d4) multiplying a predetermined reference signal with the wavelet window, the predetermined reference signal being associated with an operative fluid chamber;

(d5) dividing the result of the step (d3) by the result of the step (d4), thereby obtaining the state indicator.

8. The method according to claim 1, wherein the steps (a)-(d) are performed for a plurality of fluid chambers, thereby obtaining a plurality of state indicators, the method further comprising the step of:

(e) determining from the plurality of state indicators a state indicator value corresponding to a state indicator of an operative fluid chamber.

9. The method according to claim 8, wherein the method further comprises the steps of:

comparing the state indicator value determined in the step (e) with a predetermined reference value; and (g) determining whether the fluid has a predetermined desired viscosity based on the comparison of the step (f).

10. The method according to claim 8, wherein the state indicator value determined in the step (e) is used as a reference value for determining an operating state of each of the plurality of fluid chambers.

11. The method according to claim 1, wherein the method further comprises the steps of:

(h) supplying a set of predetermined detection signals, the set of predetermined detection signals comprising at least one detection signal originating from an operative fluid chamber and at least one detection signal originating from a non-operative fluid chamber; and providing a wavelet window suitable for distinguishing the detection signals in the set of predetermined detection signals in signals originating from an operative fluid chamber and signals originating from a non-operative fluid chamber.

12. The method according to claim 11, wherein the step (i) further comprises the step of generating the wavelet window based on the set of predetermined detection signals.

13. A printing apparatus for ejecting a droplet of an inkjet fluid, the printing apparatus comprising:

(a) at least one fluid chamber, the fluid chamber being configured for holding an inkjet fluid and for ejecting a droplet of the inkjet fluid;

(b) a pressure generator operatively coupled to the fluid chamber, the pressure generator being configured to generate a pressure wave in the fluid chamber;

(c) a detector operatively coupled to the fluid chamber, the detector being configured to detect the pressure wave in the fluid chamber and generate a corresponding detection signal; and (d) a determining device operatively coupled to the detector, the determining device being configured to receive the detection signal and determine a state indicator based on the received detection signal using a wavelet window, wherein the wavelet window is configured for use in a wavelet transformation in accordance with wavelet theory.

14. The printing apparatus according to claim 13, wherein the printing apparatus comprises a print head comprising the at least one fluid chamber, the pressure generator and the detector and wherein the determining device comprises a processing unit arranged on the print head.

15. The printing apparatus according to claim 13, wherein the pressure generator and the detector are embodied in a single element.

16. The printing apparatus according to claim 15, wherein the single element is a piezo-actuator.

17. A non-transitory computer readable medium comprising computer executable instructions for determining a state indicator from a detection signal using a wavelet window, the detection signal being received from an inkjet fluid chamber and representing a pressure wave in the fluid chamber resulting from a pressure wave generated in the inkjet fluid chamber, wherein the wavelet window is configured for use in a wavelet transformation in accordance with wavelet theory.

* * * * *